US008028450B2

(12) United States Patent
Landsman et al.

(10) Patent No.: US 8,028,450 B2
(45) Date of Patent: Oct. 4, 2011

(54) RECIPIENT VERIFICATION SYSTEMS AND METHODS OF USE INCLUDING RECIPIENT IDENTIFICATION

(75) Inventors: Kelly M. Landsman, Chicago, IL (US); Varsha G. Kalyankar, Chicago, IL (US)

(73) Assignee: Typenex Medical, LLC, Chicago, IL (US)

( * ) Notice: Subject to any disclaimer, the term of this patent is extended or adjusted under 35 U.S.C. 154(b) by 88 days.

(21) Appl. No.: 12/533,500

(22) Filed: Jul. 31, 2009

(65) Prior Publication Data

US 2010/0024268 A1 Feb. 4, 2010

Related U.S. Application Data

(60) Provisional application No. 61/085,136, filed on Jul. 31, 2008, provisional application No. 61/102,184, filed on Oct. 2, 2008.

(51) Int. Cl.
*A44C 5/00* (2006.01)

(52) U.S. Cl. ..... 40/633; 40/661

(58) Field of Classification Search ..... 40/633, 40/661, 665

See application file for complete search history.

(56) References Cited

U.S. PATENT DOCUMENTS 2,911,743 A * 11/1959 Pokras ..... 40/633
2,954,620 A 10/1960 Schneider
3,106,028 A 10/1963 Baumgartner
3,197,899 A 8/1965 Twentier
3,279,107 A 10/1966 Baumgartner
3,323,208 A 6/1967 Hurley, Jr.
3,416,200 A 12/1968 Daddona, Jr.
3,586,220 A 6/1971 Reinsberg
3,645,023 A 2/1972 Larson
3,660,916 A 5/1972 McDermott et al.
3,715,570 A 2/1973 Weichselbaum et al.
3,744,104 A 7/1973 Ford
3,744,691 A 7/1973 Shears
3,965,589 A 6/1976 McDermott
3,983,604 A 10/1976 Phillips
4,078,324 A 3/1978 Wiebe
4,122,947 A 10/1978 Falla
4,154,011 A 5/1979 Rakestraw et al.
4,164,320 A 8/1979 Irazoqui et al.
4,199,882 A 4/1980 Clayman
4,221,063 A 9/1980 Charles et al.
4,233,715 A 11/1980 McDermott
4,285,146 A 8/1981 Charles et al.
RE30,786 E 11/1981 Wiebe
4,311,740 A 1/1982 Kay (Continued)

*Primary Examiner* — Joanne Silbermann
*Assistant Examiner* — Christopher E Veraa
(74) *Attorney, Agent, or Firm* — Dicke, Billig & Czaja, PLLC

(57) ABSTRACT

A recipient verification system including a band and a label strip. The band includes a base, a trailing shield segment, and a strap. The band defines a band identification portion displaying a band identifier, as well as opposing passages. The trailing shield segment is disposed over the identification portion. The strap extends from the base and terminates at a tail end. The label strip extends from the base and includes at least one removable label displaying the predetermined band identifier. In an initial state, the strap is free of the band identification portion. In the worn state, the strap is wrapped about a wearer's appendage, with the tail end passing through at least one of the passages and a section of the strap maintained along the identification portion. The predetermined band identifier displayed on the identification portion is visible through the trailing shield segment in the worn state.

22 Claims, 8 Drawing Sheets

U.S. PATENT DOCUMENTS 4,314,415 A * 2/1982 De Woskin ..... 40/633
4,612,718 A 9/1986 Golub et al.
4,616,436 A 10/1986 De Woskin
4,682,431 A 7/1987 Kowalchuk
4,857,713 A 8/1989 Brown
4,914,843 A 4/1990 De Woskin
4,991,337 A 2/1991 Solon
5,002,212 A 3/1991 Charleton
5,088,159 A 2/1992 Lafleur
5,092,067 A 3/1992 Prout
5,147,699 A 9/1992 Browning et al.
5,164,575 A 11/1992 Neeley et al.
5,166,498 A 11/1992 Neeley
5,203,851 A 4/1993 Browning et al.
5,226,809 A 7/1993 Franco
5,283,969 A 2/1994 Weiss
5,323,554 A 6/1994 MacDonald
5,343,608 A 9/1994 MacDonald
5,401,110 A 3/1995 Neeley
5,423,574 A 6/1995 Forte-Pathroff
5,457,906 A 10/1995 Mosher, Jr.
5,479,797 A 1/1996 Peterson
5,488,846 A 2/1996 Green
5,499,468 A 3/1996 Henry
5,581,924 A 12/1996 Peterson
5,609,716 A 3/1997 Mosher, Jr.
5,615,504 A 4/1997 Peterson et al.
5,653,472 A 8/1997 Huddleston et al.
5,740,623 A 4/1998 Juhan et al.
5,758,443 A 6/1998 Pedrazzini
5,785,354 A 7/1998 Haas
5,792,299 A 8/1998 Mosher, Jr.
5,799,426 A 9/1998 Peterson
5,906,702 A 5/1999 Crawford, Jr. et al.
5,914,165 A 6/1999 Freedman
5,933,993 A 8/1999 Riley
5,973,600 A 10/1999 Mosher, Jr.
5,979,941 A 11/1999 Mosher, Jr. et al.
6,000,160 A 12/1999 Riley
6,016,618 A 1/2000 Attia et al.
6,061,618 A 5/2000 Hale et al.
6,067,739 A 5/2000 Riley
6,092,321 A 7/2000 Cheng
6,142,531 A 11/2000 Harris, II
6,255,951 B1 7/2001 De La Huerga
6,331,018 B1 12/2001 Roth et al.
6,349,493 B1 2/2002 Newman et al.
6,421,920 B1 7/2002 Jensen
6,438,881 B1 8/2002 Riley
6,445,299 B1 9/2002 Rojas, Jr.
6,510,634 B1 1/2003 Riley
6,546,656 B2 4/2003 Twentier
6,581,973 B2 6/2003 Levine et al.
6,618,602 B2 9/2003 Levin
6,641,048 B1 11/2003 Schintz et al.
6,655,063 B2 12/2003 Goodin et al.
6,685,228 B2 2/2004 Riley
6,748,687 B2 6/2004 Riley
6,782,648 B1 8/2004 Mosher, Jr.
6,863,311 B2 3/2005 Riley
6,922,148 B2 7/2005 Despotis
6,948,271 B2 9/2005 Helgeson et al.
6,971,200 B2 12/2005 Valenti, Jr.
6,976,327 B2 12/2005 Goodin et al.
7,000,951 B2 2/2006 Valenti, Jr.
7,017,293 B2 3/2006 Riley
7,017,294 B2 3/2006 Riley
7,047,682 B2 5/2006 Riley
7,119,690 B2 10/2006 Lerch et al.
7,137,216 B2 11/2006 Ali et al.
7,188,764 B2 3/2007 Penuela
7,197,842 B2 4/2007 Ali
7,198,190 B2 4/2007 Juhan et al.
7,204,425 B2 4/2007 Mosher, Jr. et al.
7,207,488 B2 4/2007 Hammerslag et al.
7,222,448 B2 5/2007 Riley
7,240,446 B2 7/2007 Bekker
7,286,055 B2 10/2007 Girvin et al.
7,320,194 B2 1/2008 Ali et al.
7,322,613 B2 1/2008 Penuela et al.
7,325,347 B2 2/2008 Riley
7,386,949 B2 6/2008 Riley
7,481,370 B2 1/2009 Davis et al.
2003/0177681 A1 9/2003 Riley
2004/0237366 A1 12/2004 Chadwick et al.
2005/0091896 A1 5/2005 Kotik et al.
2005/0108912 A1 5/2005 Bekker
2005/0279001 A1 12/2005 Riley
2006/0005441 A1 1/2006 Riley et al.
2006/0059753 A1 3/2006 Riley et al.
2006/0059754 A1 3/2006 Riley
2006/0113788 A1 6/2006 Riley
2006/0168861 A1 8/2006 Riley
2006/0218836 A1 10/2006 Riley
2006/0218837 A1 10/2006 Riley
2006/0236578 A1 10/2006 Saint et al.
2006/0254105 A1 11/2006 Chang
2007/0089342 A1 4/2007 Jain et al.
2007/0120358 A1 5/2007 Waggoner et al.
2007/0157498 A1 7/2007 Ali et al.
2007/0220796 A1 9/2007 Riley et al.
2007/0283607 A1 12/2007 Sloot
2008/0028655 A1 2/2008 Riley
2008/0067802 A1 3/2008 Bell et al.
2008/0098636 A1 5/2008 Greer

* cited by examiner

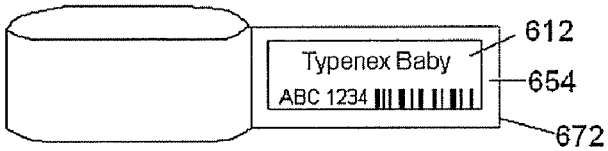
FIG. 6C
FIG. 6E
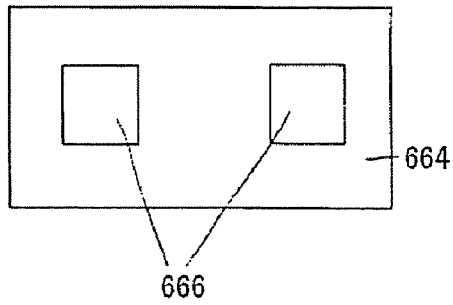
FIG. 6D
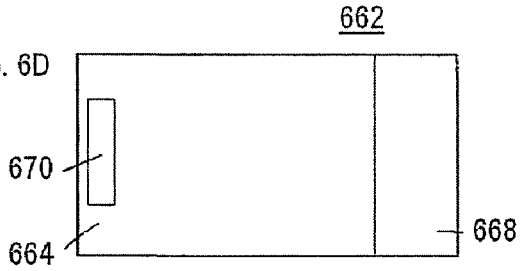

RECIPIENT VERIFICATION SYSTEMS AND METHODS OF USE INCLUDING RECIPIENT IDENTIFICATION

CROSS-REFERENCE TO RELATED APPLICATION

This application claims priority under 35 U.S.C. §119(e)(1) to U.S. Provisional Patent Application Ser. No. 61/085,136, filed Jul. 31, 2008, entitled "Recipient Verification System and Methods of Use, Including Patient Identification", and bearing and U.S. Provisional Patent Application Ser. No. 61/102,184, filed Oct. 2, 2008, entitled "Recipient Verification System and Methods of Use, Including Patient Identification", and bearing and the entire teachings of both of which are incorporated herein by reference.

BACKGROUND

The present disclosure relates to recipient verification bands and related systems, for example patient identification systems. More particularly, it relates to wearable verification bands for use in various environments, such as caregiver environments, that provide users with various labels and labeling methods, which can be linked to the wearer of the band, such systems being amenable for various end applications, and methods for making the same.

The need to assign a unique code or other identifier to a person or thing (collectively referred to as a "recipient") and subsequently employ the identifier in correlating other articles or activities to the recipient arises in a number of contexts.

For example, positive patient identification is a critical step in providing medical treatment to patients in a caregiver environment (e.g., hospital). Commonly, an identification band is issued to the patient at the time of admission to the caregiver institution, and is worn by the patient at all times (e.g., a flexible plastic wristband or ankle band). The so-issued identification/admission band typically displays (e.g., printed or labeled) patient-related information, such as name, date of birth, etc. In some instances, a unique patient identifier or other code is assigned to the patient and is displayed on the band, including, for example, bar code or numeric/alphanumeric code. The patient identifier can alternatively be supplied on a separate band (apart from the admission band), and is used to cross-reference other caregiver-related items with the patient via, for example, an electronic data base. The unique patient identifier provides an independent, physical link to the patient. For example, paperwork or other caregiver documents/medical charts relating to the patient may include the patient identifier. In addition, the patient identifier can be applied to specimen samples (e.g., test tubes for blood specimens) taken from the patient, or applied to therapeutic material(s) to be given to the patient, to better ensure that these and other items are accurately associated with the correct patient at all stages of the patient's visit with the caregiver institution. Along these same lines, similar recipient verification needs arise apart from hospital admission, for example blood banks, pharmacy, trauma centers, etc.

As a point of reference, there are multiple situations where lack of immediate patient identification (or other recipient verification) can pose significant safety risks, including trauma situations and blood transfusion to name but two. To facilitate accurate transposition of the patient identifier (and possibly other patient-related information) to items apart from the band(s) worn by the patient, it is known to provide one or more labels or tags that display the same patient identifier, or permit a caregiver to enter the patient identifier on to the label/tag. While viable, the process of transferring the patient identifier from the patient to their specimens, test requests, and other items and then back to the patient is prone to error. First, if the unique patient identifier or patient information must be transcribed by hand, the potential for human error will arise. Second, the patient identifier and/or patient information must be correctly transferred to the specimen/item in question. Hospital admission bands are commonly supplied with a plurality of patient identifying labels. In addition, laboratory test requests often can generate multiple patient identifying labels. In order to avoid transcription errors, it is desirable to use these patient identification labels in combination with the unique patient identifier.

While systems do exist that address multiple and general components of a hospital's procedure, available systems unfortunately may also give rise to other concerns, such as the patient removing the band (for example, due to discomfort), an insufficient supply of labels, absence of label(s) sized/formatted for one or more common applications, damaging of otherwise unprotected labels, etc.

In light of the above, a need exists for an improved recipient verification system.

SUMMARY

Some aspects in accordance with principles of the present disclosure relate to a recipient verification system including a band and a label strip. The band includes a base, a trailing shield segment, and a strap. The band defines a band identification portion displaying a predetermined band identifier, as well as opposing first and second passages. The trailing shield segment is disposed over the band identification portion. The strap extends from the base and terminates at a tail end. The label strip also extends from the base and includes at least one removable label displaying the predetermined band identifier. With this configuration, the recipient verification system is transitionable from an initial state to a worn state. In the initial state, the strap is free of the band identification portion. In the worn state, the strap is wrapped about a wearer's appendage, with the tail end passing through at least one of the passages and a section of the strap maintained along the band identification portion. In this regard, the predetermined band identifier displayed on the band identification portion is visible through the trailing shield segment in the worn state. The band identifier on the base is thus protected from the environment via the trailing shield segment, yet is readily available for confirming desired correlation between the worn band and the removable label once removed from the label strip. In some embodiments, transitioning of the recipient verification system from the initial state to the worn state includes locating the strap section between the band identification portion and the trailing shield segment, with the predetermined band identifier on the band identification portion being visible through both of the strap section and the trailing shield segment. In yet other embodiments, the base further forms a recipient information portion on which recipient-specific information can be added (e.g., via a label).

Other aspects in accordance with principles of the present disclosure relate to a method of manufacturing a recipient verification system. The method includes forming a band including the base and the trailing shield segment as described above. A label strip including at least one removable label is also formed and assembled to the band. Upon final assembly, a predetermined band identifier is displayed on the band identification portion and the removable label, with the resultant system being transitionable from the initial state to the worn state as described above. In some constructions, the label strip and the band are separately formed from differing material webs, with the predetermined band identifier being printed onto a permanent label provided with the label strip and subsequently bonded to the band identification portion.

Yet other aspects in accordance with principles of the present disclosure relate to a method of using a recipient verification system. The method includes receiving a recipient verification system as described above and including the band and the label strip. The strap is wrapped about a recipient's appendage, and the tail end of the strap is inserted through at least one of the passages. The strap is secured to the base such that a section of the strap is maintained along the band identification portion, with the predetermined band identifier on the band identification portion being visible through the trailing shield segment. In some embodiments, the band base further defines a recipient information portion, with the method further including a user printing recipient information onto a separate label, and then bonding the label to the recipient information portion.

BRIEF DESCRIPTION OF THE DRAWINGS

FIG. 6C is a side view of a portion of the label strip structure of FIG. 6A applied to a band;

FIGS. 6D and 6E are simplified views of a holder device useful with portions of the label strip structure of FIG. 6A;

DETAILED DESCRIPTION

Aspects of the present disclosure relate to various recipient verification systems useful in a variety of different environments. For example, the recipient verification systems of the present disclosure can be used in medical or patient-related contexts, such as with patient admission to a hospital (and related medical records, charts, items (e.g., clothing), etc.), testing or specimen drawing (e.g., X-rays, blood specimen, DNA specimen, organ donation, stem cell specimen, fertilized eggs, etc.) entirely apart from (or as part of) a hospital stay, blood banks, pharmacies (e.g., custom chemotherapy drugs, nuclear pharmacy, labor and delivery, etc.), or other instances in which patient identification is needed. Other applications are equally appropriate, such as police or security situations in which a number of individuals must be quickly processed on-site, ticketing applications, etc. Thus, while several of the examples described below mention patient identification, as well as hospital admission, the systems of the present disclosure are in no way limited.

Figure 1A:
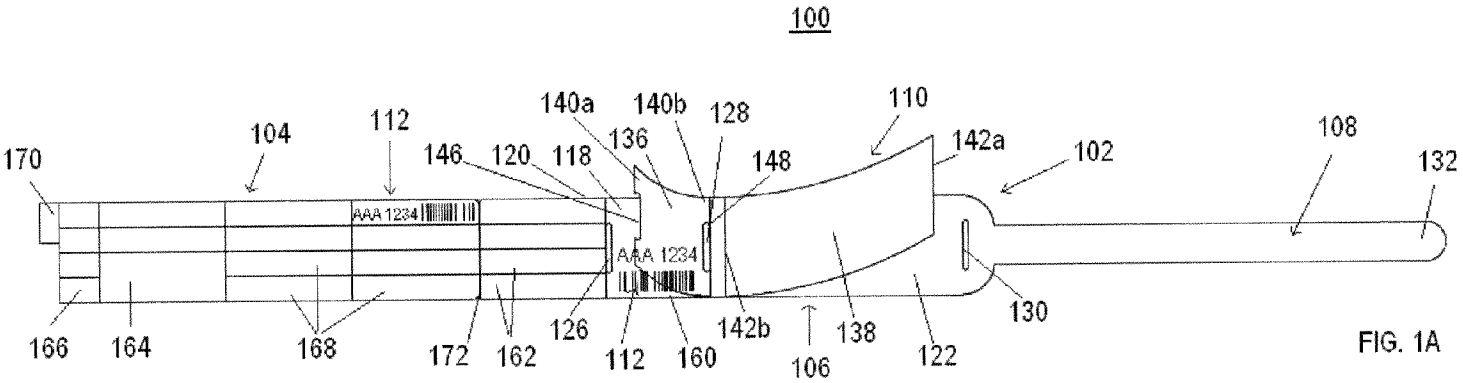
FIG. 1A is a simplified top view of a recipient verification system in accordance with the principles of the present disclosure and in an initial state.
Figure 1B:
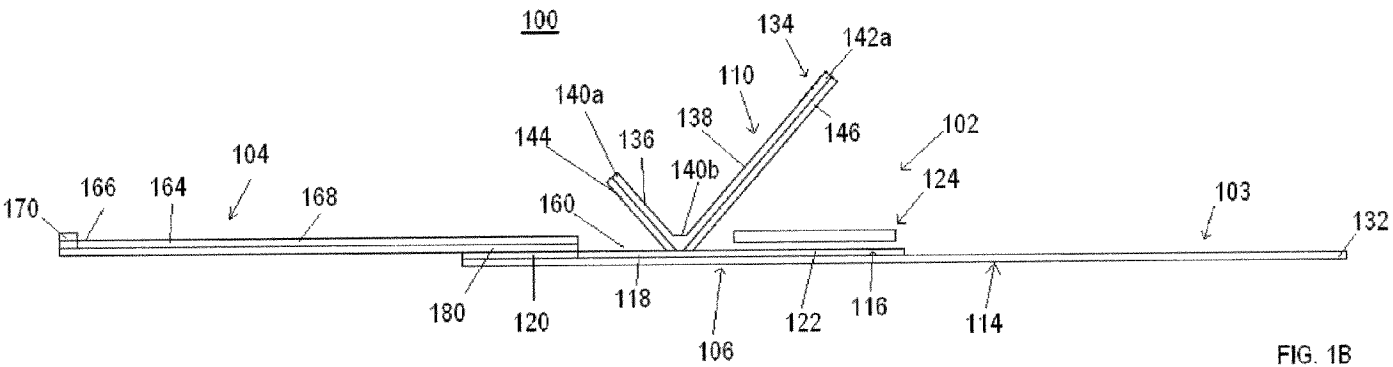
FIG. 1B is a simplified side view of the system of FIG. 1A and illustrates layers as present in the initial state.

One configuration of a recipient verification system 100 in accordance with aspects of the present disclosure is shown in FIGS. 1A and 1B. The recipient verification system 100 includes a band 102 and a label strip 104. Details on the various components are provided below. In general terms, however, the band 102 forms or defines a base 106, a strap 108, and a shield 110. The label strip 104 extends from the base 106 opposite the strap 108, with the base 106 and the label strip 104 displaying an identical, predetermined band identifier 112. With this configuration, the recipient verification system 100 is transitionable from an initial state of FIGS. 1A and 1B, in which the strap 108 is free of the base 106 and the system 100 is not yet applied to a recipient, to a worn state in which the strap 108 is wrapped about a recipient's appendage and connected to the base 106 as described below. In the worn state, the predetermined band identifier 112 on the base 106 is protected by, and visible through, the shield 110.

In some embodiments, the base 106 and the strap 108 are commonly constructed by a material web including a bottom layer 114 formed of a transparent or substantially transparent (e.g., at least 90% transparent) polymer film adapted for contact with human skin. An optional second layer 116 (e.g., polymer film) can be laminated to the bottom layer 114 to reinforce the base 106. Regardless, the base 106 forms or defines a band identification portion 118, a strip attachment portion 120, and an optional recipient information portion 122 sized to receive an optional recipient information label (e.g., a hospital label) 124. The recipient information portion 122 may contain the additional laminate structure(s) 116 and/or prompts that instruct the caregiver to place the recipient information label 124 onto that location. As a point of reference, the recipient information label 124 is removed from the view of FIG. 1A to better illustrate the recipient information portion 122, but is shown in FIG. 1B. In other embodiments, the recipient information portion 122 can be eliminated. Regardless, the predetermined band identifier 112 is displayed on the band identification portion 118, either by direct printing or a separately applied permanent label as described below. Finally, the strip attachment portion 120 can be described as a continuation of the band identification portion 118 and provides a surface for assembly of the label strip 104.

The base 106 further forms first, second, and optional third passages 126-130 through a thickness thereof. The first and second passages 126, 128 are formed at opposing sides of the band identification portion 118 in a manner not obstructing the predetermined band identifier 112 provided thereon. The first passage 126 is sized to slidably receive the strap 108 (e.g., slightly larger than a width of the strap 108). The second passage 128 can be similarly sized to receive the strap 108. Alternatively, the second passage 128 can be sized to receive a separate attachment device (not shown) configured for capturing the strap 108 in the worn state. Where provided, the optional third passage 130 is formed along the recipient information portion 122 adjacent the strap 108 and serves as part of a band replacement feature as described in U.S. application Se. No. 12/465,449 filed May 13, 2009 and entitled "Recipient Verification Systems and Methods of use, Including Patient Identification"; the entire teachings of which are incorporated herein by reference. While the passages 126-130 are illustrated as being closed-ended slots, other configurations are also acceptable (e.g., holes, perforations, slots open to an edge of the base 106, etc).

The strap 108 is sized for placement about a recipient's appendage (e.g., wrist or ankle), and terminates at a tail end 132 that is sized for insertion (e.g., threading) through the first passage 126, and optionally the second passage 128.

The band 102 can be formed and assembled in a variety of manners. In some embodiments, the band 102 is initially defined as a die-cut, single or multi-layer laminate structure, formed apart from the label strip 104 (i.e., the band 102 and the label strip 104 are not commonly defined in a single form-like structure). The strap 108 is integrally formed with the base 106 such that the band base 106 and the strap 108 form a contiguous, homogeneous body. The laminate material(s) are selected to be flexible, resistant to tearing, durable, acceptable for contact with human skin, and take into account patient comfort. For example, acceptable laminate material (s) include polyethylene, polyester, vinyl, nonwoven foams, low-density polyethylene/COC blends, Tyvek™, etc. Alternatively, the base 106 and the strap 108 can be formed of differing materials, (e.g. the strap 108 can be Tyvek™ to allow for comfort while the base 106 can be polyethylene to provide a more structured base for the corresponding segments of the label strip 104).

The shield 110 is attached to the base 106 and includes a transparent or substantially transparent film layer 134 defining a trailing shield segment 136 disposed over the band identification portion 118. In some constructions, the shield 110 further forms a leading shield segment 138 disposed over the recipient information portion 122.

More particularly, the trailing shield segment 136 defines a leading end 140*a* and a trailing end 140*b;* similarly, the leading shield segment 138 defines a leading end 142*a* and a trailing end 142*b*. In the initial state of FIGS. 1A and 1B (i.e., the system 100 is finally assembled, but prior to physical connection of the system 100 to a recipient), the trailing ends 140*b*, 142*b* are attached to the base 106 as shown. The leading ends 140*a*, 142*a* are free of the base 106 and can be readily moved relative to the base 106. An optional release liner 144 can be provided with the trailing shield segment 136 and an optional release liner 146 can be provided with the leading shield segment 138 to further promote this desired movement. The release liners 144, 146 temporarily cover a clear adhesive coating or layer provided along an underside of the shield film 134. Upon final assembly of the system 100 to a recipient as described below, the leading end 142*a* of the trailing shield segment 136 is connected to the base 106, as is the leading end 142*a* of the leading shield segment 138. In this regard, the trailing end 142*b* of the leading shield segment 138 originates at the end of the recipient information portion 122 and is sized to completely cover the applied recipient information label 124 while terminating adjacent (but spaced from) the third opening 130. Further, in some embodiments, the trailing shield segment 136 forms a leading notch 146 or other opening commensurate with the first opening 126 in the base 106 and a trailing aperture 148 or other opening commensurate with the second opening 128.

The shield 110 can be made of a clear material that facilitates legibility of the code and scanning/reading of barcodes or other communication means (RFID, etc.) The trailing shield segment 136 and the leading shield segment 138 can be one piece attached to the band base 106 via an exposed adhesive area 150 or separate pieces each having their own adhesive attachment means. In alternate embodiments, the adhesive attachment area 150 that attaches the shield 110 to the base 106 can be replaced with an ultrasonic weld, solvent bond, or other attachment means.

The label strip 104 is composed, in some embodiments, of a permanent label 160, a series of removable labels 162 (which remain connected with the band 102 and thus to the recipient until the time of use as described below), a test tube label 164, a series of detachable labels 166, 168, and an adhesive tab 170. In one embodiment, the label strip 104 is printed onto one continuous backing. The size, shape, and/or number of the labels 162-168 can vary as desired; however, at least one removable label (apart from the permanent label 160) is provided with the label strip 104. Regardless, the band identifier 112 is identically displayed (e.g., printed) by the permanent label 160 as well as the at least one removable labels; in some embodiments, the band identifier 112 is displayed by every discrete label defined by the label strip 104. As a point of reference, while FIGS. 1A and 1B illustrate the band identifier 112 as being displayed by or on only one of the labels of the label strip 104 apart from the permanent label 160, it will be understood that the band identifier 112 can be displayed on two or more or all of the labels 162-168.

The label strip 104 is formed separately from the band 102, and is subsequently adhered to the base 106 in the areas of the permanent label 160 and the removable labels 162. The location of the label strip 104 relative to the band 102 is not limited by what is described herein. The detachable labels 166, 168 and the adhesive tab 170 can be connected to the band 102 at any location relative to the band 102 that facilitates their removal via an area of weakness 172. The line or area of weakness 172 is formed through a thickness of the label strip 104; thus, relative to the orientation of FIG. 1A, all portions of the label strip 104 to the left of the line of weakness 172 can be entirely detached from all portions of the label strip 104 to the right. It is desirable that if two or more of the labels 160-168 are intended to display the same indicia (i.e., the predetermined band identifier 112), whether the test tube label 164, the detachable label 166, 168, the removable label 162 and/or the permanent label 160, the labels 160-168 are identical in their markings to ensure patient safety. Detachable labels 164-168 and removable labels 162 can be provided in any quantity or format desired by the user.

The predetermined band identifier 112 displayed on the label strip 104 and the base 106 is assigned or created on a variable basis by a manufacturer of the system 100 (as opposed to a caregiver institution user of the system 100 or the recipient). The predetermined band identifier 112 can be indicia in one or more formats such as: barcode and other configurations depending on the situation and process needs. The band identifier 112 can assume a wide variety of formats, and can be applied to the recipient verification system 100 in various manners. For example, in some exemplary embodiments, the band identifier 112 includes a unique band code that is generated in one or more forms such as alphanumeric, barcode, magnetic stripe, RFID, etc. Regardless, a different, unique band code can be created for each new recipient verification system 100 supplied to an institution making use of the system 100, with the institution optionally maintaining an electronic database (or written records) that assigns the unique band code to a particular recipient to whom the system 100 in question is applied. Subsequently, that same, unique band identifier code is then correlated in the database with relevant recipient information. For example, the recipient can be a patient being admitted to a hospital and/or submitting test specimen(s) at a laboratory. Prior to delivery of the recipient verification system 100 to the user and subsequent correlation with a particular recipient, the band identifier 112 does not embody recipient-specific information. In some constructions of the present disclosure, a kit of recipient verification systems can be provided to a user (e.g., hospital). The kit consists or two or more of the recipient verification systems 100 as described; the recipient verification systems are identical to one another except that each individual system 100 has a uniquely assigned band identifier 112. Alternatively, the band identification indicia can assume other forms (such as prompts, instructions, icons, etc.), and/or content; and in other embodiments can be omitted. A printer system and label stock can be used to make more of the detachable labels 168 at the point of use. The recipient verification system 100 can contain colors, icons, or other means that aid caregivers and patients in identifying the purpose/intent of the system 100.

The strap 108 is adapted for placement about a user's wrist, ankle, or other appendage (as a point of reference, FIGS. 1A and 1B illustrate the recipient verification system 100 prior to placement about the user's appendage), with the shield 110 effectuating a tamper-evident, non-transferable connection upon final assembly of the system 100 to the recipient. The label strip 104 is physically connected to the base 106 in the areas of the permanent label 160 and removable labels 162, but is a separate layer from the band 102 in the area of the test tube label 164, the detachable labels 166, 168, and the adhesive tab 170 via the weak spot 172 in the label strip 104 material. With the above construction, assembly of the system 100 includes bonding the permanent label 160 to the band identification portion 118, and the removable labels 162 to the strip attachment portion 120. Placement of the permanent label 160 thus permanently associates the band identifier 112 displayed on the permanent label 160 with the base 106. Alternatively, the permanent label 160 can be formed separately from a remainder of the label strip 104 and applied to the band identification portion 118. In yet other embodiments, the band identifier 112 is directly printed or otherwise directly applied to the band identification portion 118, such that the permanent label 160 can be omitted.

In general, the process for the application and use of the recipient verification system 100 can proceed as follows. First, any hospital label, card, tab, or other carrier mechanism will be transcribed with desired information, for example recipient, caregiver, and/or other hospital related information. The resultant recipient information label 124, which can come in any format or material per the specific hospital's procedure, is placed on, and bonded to, the recipient information portion 122. The leading shield segment 138 is then sealed down over the recipient information label 124, for example by first removing the release liner 146 and then sealing the leading shield segment 138 to the base 106. This provides protection to the applied recipient information label 124.

The recipient verification system 100 is then connected to a recipient, for example placed about the recipient's appendage. This can be accomplished by wrapping the strap 108 about the appendage, inserting the tail end 132 of the strap 108 into the first passage 126, continuing to wrap the tail end 132 across the permanent label 160 (e.g., between the base 106 and the trailing shields segment 136), and then by inserting the tail end 132 through the second passage 128. The strap 108 is then captured to the base 106 by sealing down the trailing shield segment 136 after removing the optional release liner 144 to expose an adhesive surface. In an alternate embodiment, the trailing shield segment 136 has points or lines of weakness that aid in tamper evidence. The remaining length of the strap 108, once the system 100 is attached to the recipient, can be stored by inserting it into the second passage 128. In other embodiments, the excess strap 108 material can be removed (if desired) using a scissor or equivalent means. Regardless, a section of the strap 108 extends across or above the band identification portion 118, including the band identifier 112 displayed thereon. Due to the transparent or substantially transparent nature of the strap 108 and the trailing shield segment 136, the band identifier 112 on the base 106 is visible to a user "through" the strap section and the trailing shield segment 136 in this worn state.

Once the recipient verification system 100 is attached to the recipient, the test tube label 164 can be removed from a corresponding backing 180 and placed on any number of specimen carrying vehicles when desired. Then, the detachable labels 166, 168, and the adhesive tab 170 can be removed together at the weak spot 172. The detachable labels 166, 168 travel with the specimen (or specimen carrying vehicles) and can be attached to the specimen or any paperwork, etc., via the adhesive tab 170. In some embodiments, the adhesive tab 170 is attached to the recipient sample tube prior to applying the system 100 to the patient and/or drawing the patient sample. The removable labels 162 remain with the recipient (following removal of the detachable labels 166, 168 portion of the label strip 104 from a remainder thereof via the line of weakness 172) in case they are needed to label anything related to the recipient (another specimen, paperwork, etc.) at a later time. All of the labels 162-168 display the same band identifier 112 and thus, when placed on any specimen, order form, paperwork, drugs, organs, tissues, or blood being delivered to the recipient can then be compared against the band identifier 112 on the base 106 (e.g., the permanent label 160) to ensure recipient verification. The recipient information label 124 (e.g., hospital label or other applied information), which is still on the recipient verification system 100 and thereby still attached to the recipient and protected by the leading shield segment 138, can then be accessed for further recipient identification (by comparing applied information on the recipient information label 124 to medical records, for instance). In some embodiments, the band identifier 112 on the base 106 is read and/or used to ensure proper delivery of recipient-intended products using a bedside scanning device.

Figure 2A:
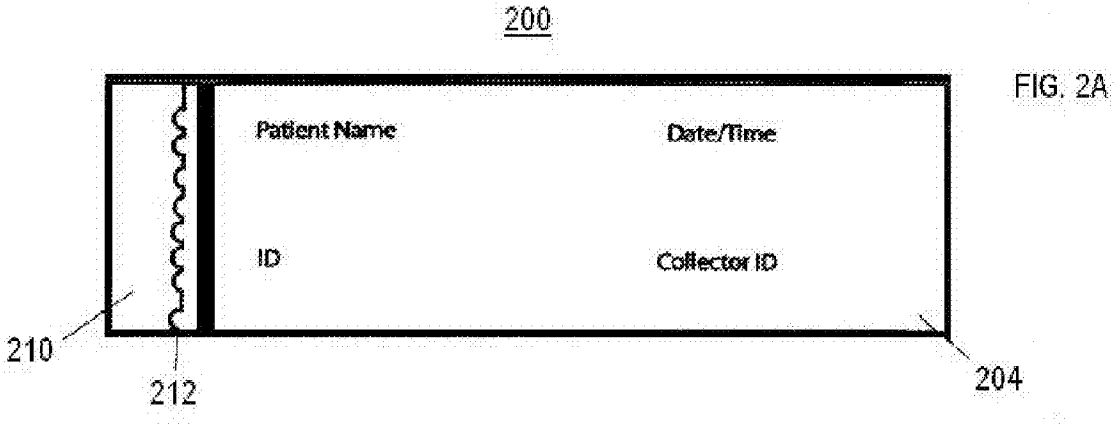
FIG. 2A is a simplified, enlarged top view of an insert useful with systems of the present disclosure.
Figure 2B:
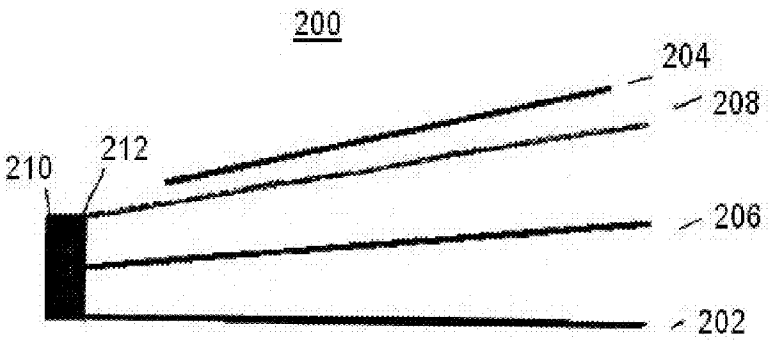
FIG. 2B is a side view of the insert of FIG. 2A.

In some institutions or applications, preprinted hospital labels are not available, and/or handwritten label formats are preferred. Under these circumstances, the recipient information portion 122 can be formatted to be ink-receptive for receiving hand-written information. It is desirable to avoid transcription errors and ensure that the information on the patient-attached portion of the recipient verification system 100 is identical to that on the specimen or other recipient related vehicle. FIGS. 2A and 2B show top and side views of a write-on label construction or insert 200 useful as the recipient information label 124 of FIG. 1B. When recipient information is applied to the recipient verification system 100, the label construction 200 is placed over the recipient information portion 122. In some embodiments, a liner layer 202 may protect image material carried by the label construction 200 from premature transfer. The liner layer 202 is removed prior to writing. A label/face stock layer 204 displays prompts that suggest desirable information that can be written on to the label/face stock layer 204 using, for example, a ballpoint pen. Desired information is written onto the face stock layer 204 and is transferred via image paper or similar material layer(s) 206 to the desired surface. The label layer 204 that is intended for the recipient specimen or other recipient-related vehicle is removed from a corresponding release liner 208 and applied as desired. In some embodiments, the layers 202-208 are attached to one another for convenience of use by a connector piece 210. Layers such as the liner layer 208 can be removed via a weakened area 212 located between the layers 202-208 and the connector 210. This information label construction 200 can stand alone, or be attached to the recipient information portion 122 (FIG. 1A) in a variety of ways.

Figure 3A:
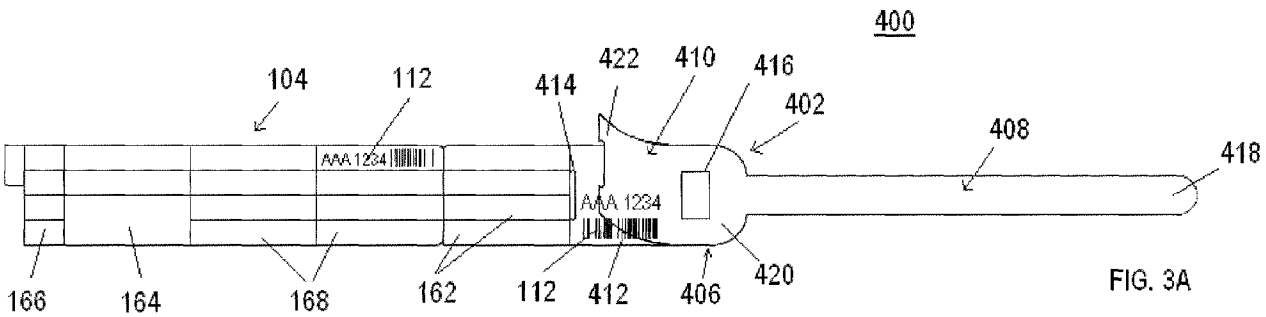
FIG. 3A is a simplified top view of another recipient verification system in accordance with principles of the present disclosure, in an initial stage of manufacture.

Another embodiment of a recipient verification system 400 in accordance with principles of the present disclosure is shown in FIG. 3A in an initial state. The recipient verification system 400 is akin to the recipient verification system 100 (FIG. 1A) described above, and includes a band 402 and the label strip 104. The label strip 104 can assume any of the constructions described above. The band 402 includes a base 406, a strap 408, and a trailing shield segment 410. The base 406 defines a band identification portion 412, as well as opposing first and second passages 414, 416. The strap 408 extends from the base 406 and terminates at a tail end 418. The trailing shield segment 410 is attached at a first end 420 (referenced generally) to the base 406. An opposite, second end 422 of the trailing shield segment 410 is free of the base 406 in the initial state of FIG. 3A. Finally, the recipient verification system 400 includes the predetermined band identifier 112 on the band identification portion 412 (e.g., via the permanent label 160 as described above), as well as on at least one of the removable labels 162-168 of the label strip 104.

Figure 3B:
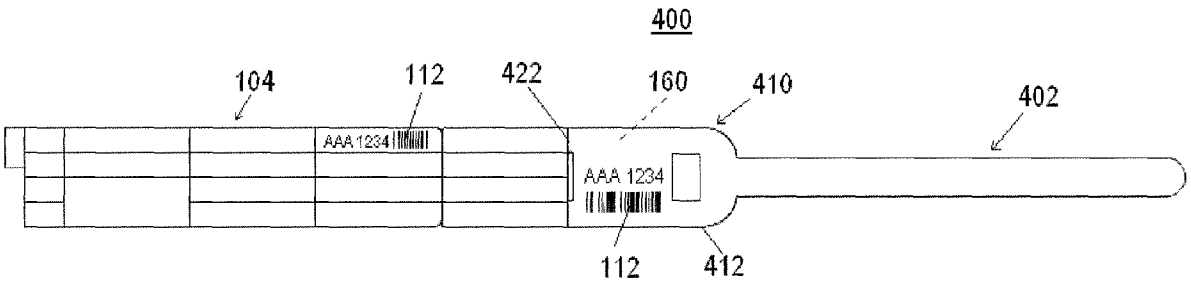
FIG. 3B is a top view of the system of FIG. 3A following manufacture and in an initial state.
Figure 3C:
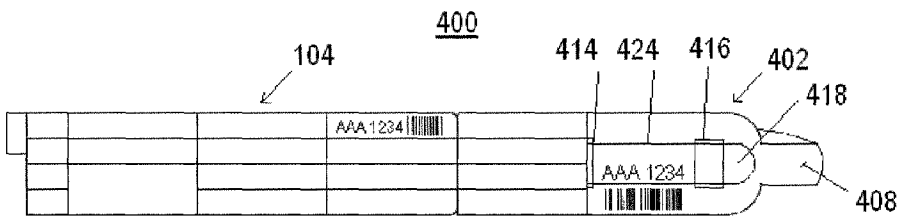
FIG. 3C is a top view of the system of FIG. 3A in an worn state.

With reference to FIG. 3B, assembly of the recipient verification system 400 includes attaching the label strip 104 to the band 402. For example, and as described above, the label strip 104 can include the permanent label 160 on which the predetermined band identifier 112 is printed. With this construction, the permanent label 160 is attached to the band identification portion 412. The second end 422 of the trailing shield segment 410 is then attached to the permanent label 160/band identification portion 412 so as to protect the band identifier 112 from the environment. The so-assembled recipient verification system 400 of FIG. 3B can then be transitioned to a worn state as reflected, for example, in FIG. 3C. In particular, the strap 408 is wrapped about a recipient's appendage, and the tail end 418 inserted through the first passage 414 and the second passage 416. Thus, a section 424 of the strap 408 extends across or above the band identification portion 412, and in particular the predetermined band identifier 112 displayed thereon. The tail end 418 is then secured to the base 406, for example via an adhesive backing (not shown). In the worn state, the recipient verification system 400 can be used in any of the manners previously described including, for example, applying one or more of the removable labels 162-168 from the label strip 104 onto an item for which recipient verification is desired.

Figure 4A:
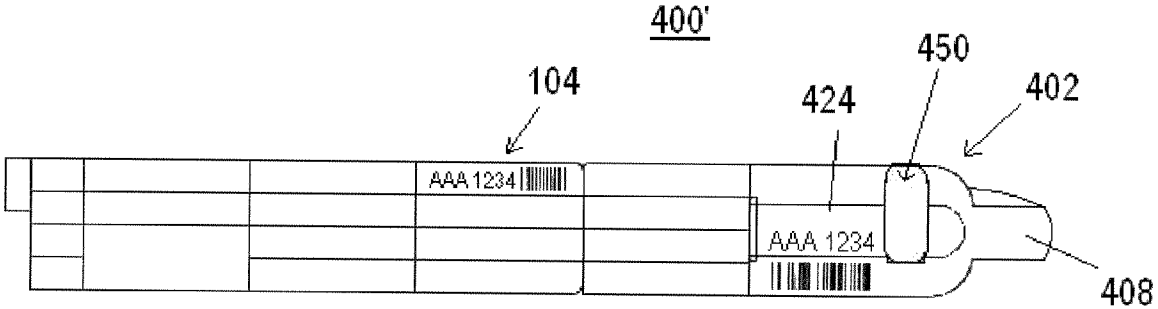
FIG. 4A is a simplified top view of another recipient verification system in accordance with principles of the present disclosure and in a worn state.
Figure 4B:
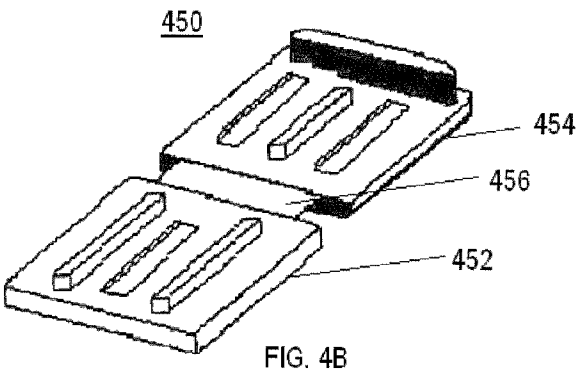
FIG. 4B is a perspective view of a closure mechanism useful with the system of FIG. 4A.

A related embodiment recipient verification system 400' is shown in a worn state in FIG. 4A. The recipient verification system 400' is highly akin to the recipient verification system 400 (FIG. 3A) described above, and again includes the band 402 and the label strip 104. In addition, a closure mechanism 450 is provided, and secures the strap section 424 onto the base 406 in the worn state. The closure mechanism 450 can assume a wide variety of forms, one of which is shown in greater detail in FIG. 4B. With this but one acceptable construction, the closure mechanism 450 includes opposing, snap-together bodies 452, 454 that are interconnected by a living hinge 456. During use, the bodies 452, 454 are disposed at opposite sides of the base 406 as generally reflected in FIG. 4A, and permanently capture the strap 408 therebetween. To facilitate a more complete attachment, the interconnecting portions of the bodies 452, 454 can be connected to one another through the second passage 416 (FIG. 3A) in the base 406. The user may choose to insert the strap 408 into the second passage 416 to capture the tail end 418, or simply lay the strap 408 above the second passage 416.

Figure 5A:
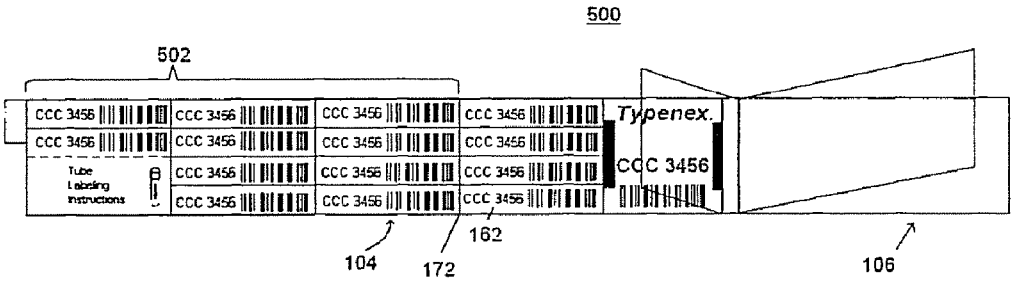
FIG. 5A is a simplified top view of a portion of another recipient verification system in accordance with principles of the present disclosure.

FIG. 5A shows a portion of another embodiment recipient verification system 500 in accordance with the present disclosure. The system 500 is highly akin to the recipient verification system 100 (FIG. 1A) described above, and includes the label strip 104 secured to the base 106. In this configuration, a detachable portion 502 of the label strip 104 is removable from the system 500, and in particular from attachment to the base 106, at the area or line of weakness 172. The removable labels 162 remain attached to the base 106 with the use of an adhesive layer 504 (FIG. 1B) or similar means, and are available for removal as needed.

Figure 5B:
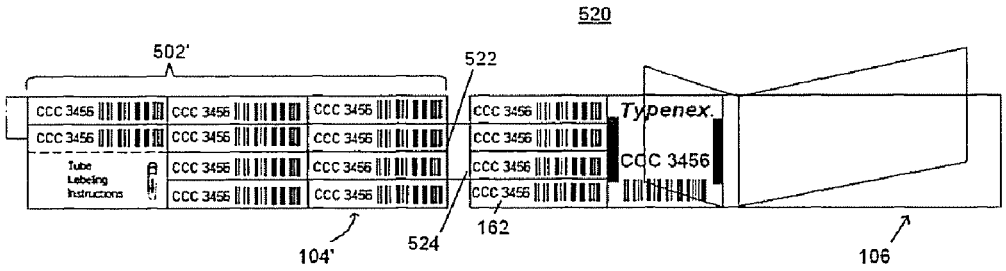
FIG. 5B is a simplified top view of a portion of another recipient verification system in accordance with principles of the present disclosure.

Another embodiment verification system 520 is partially shown in FIG. 5B and is also akin to the system 100 (FIG. 1A) described above, but provides a label strip 104' in which the removable labels 162 are free from the base 106 (i.e., not bonded to the base 106). The removable labels 162 remain "on" the recipient (i.e., attached to the base 106that is otherwise secured to the recipient) after a detachable portion 502' is removed via a point or line of weakness 522. The system 520 can provide various advantages including: accessibility and ease of scanning barcodes (due to a non-curved surface), minimization of minimum bracelet circumference, etc. Further, the system 520 can include an adhesive area 524 that allows a free end of the removable labels 162 to be attached to the base 106 and/or the strap 108 (shown in FIGS. 1A and 1B) after the system 520 has been applied to a recipient. In some embodiments, the adhesive area 524 may be located on a back of the free end of the removable labels 162. In use, the recipient verification system 520 would be applied as described above. The detachable label portion 502' can be removed at the point of weakness 522 when desired. Then, the now-free removable labels 162 could then be attached to the base 106 and/or the strap 108 (FIG. 1A) using the adhesive area 524 or equivalent means. This feature can serve to minimize nuisance or discomfort caused by the free area of the removable labels 162 remaining after the system 520 is applied to a recipient.

Figure 5C:
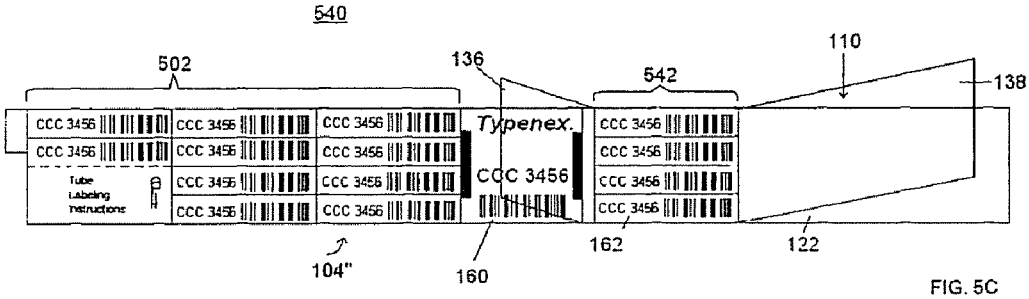
FIG. 5C is a simplified top view of a portion of another recipient verification system in accordance with principles of the present disclosure.

A portion of another recipient verification system 540 is shown in FIG. 5C and incorporates an alternate way to avoid generating a "free end" for the removable labels 162. In this embodiment, the label strip 104" is configured such that the removable labels 162 are between the permanent label 160 and the recipient information portion 122. With this design, open space is preferably available to adhere the shield segments 136, 138 to the base 106. Alternatively, the shield 110 may be initially adhered to the base 106 by a laminating area 542 over the removable labels 162 and subsequently die cutting the removable labels 162 so as to be removable from the base 106.

Figure 6A:
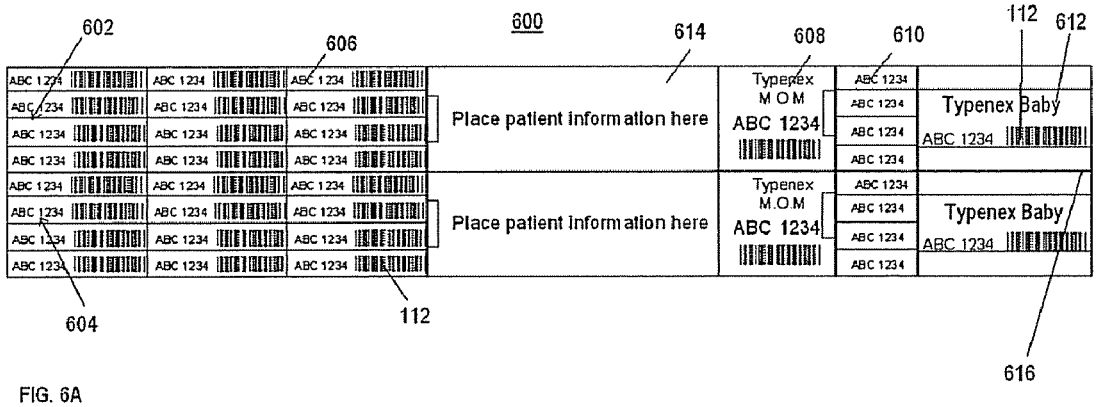
FIG. 6A is a simplified top view of a label strip structure useful with recipient verification systems of the present disclosure.

As described previously, recipient verification can be used for multiple applications. One such application is matching parents to newborn babies. FIG. 6A shows a label strip structure 600 configuration that would enable recipient verification in this application. The label strip structure 600 and method can be applied to any of the embodiments described above and thus is described generally here.

The label strip structure 600 contains first and second duplicate label strips 602 and 604 attached to one another. The strips 602, 604 incorporate one or more of the labels described above, such as a plurality of detachable labels 606 which display the band identifier 112 identical to that of labels 608, 610, 612. The format and number of labels 606-612 is not limited by what is shown. In some embodiments, the detachable labels 606 contain an umbilical clamp label containing the unique identifier 112. Further, an information region 614 is provided on each of the label strips 602, 604, and is a place for patient information. Information can be applied to the region 614 in any number of formats including preprinted hospital label, handwriting, handwritten insert, etc. The label 608 is a permanent label that stays with the patient. The label 612 is attached to the corresponding baby. In the case of multiple births, multiple ones of the labels 612 could be supplied. As shown previously, the label 612 can alternately be part of the detachable labels 606.

To produce two identical systems containing the same unique identifier 112, the base band (not shown, but akin to the band 102 of FIG. 1A) could be attached to the label strip structure 600 as described in a number of different embodiments above, except in duplicate (or twice the width of one band). Then the desired shape would be cut for each band. A weakened point 616 could be made between the two identical bands/label strips 602, 604 so that they can be separated at the time of use (one each per parent). The band(s) would then be attached to the parent and at the time of birth, and the label 612 is then removed and adhered to the baby's identification means.

Figure 6B:
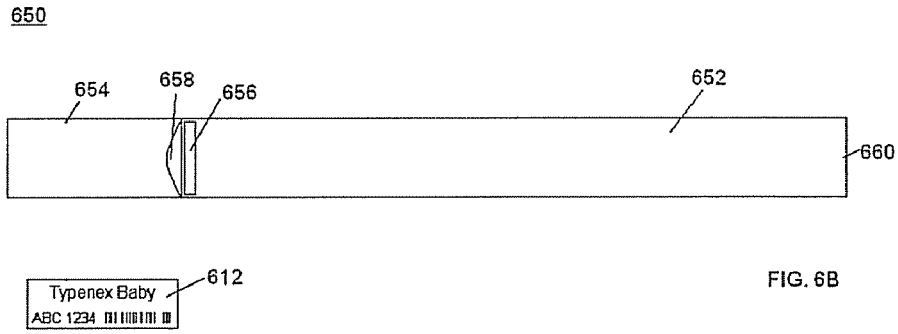
FIG. 6B is an exploded view of a banding system useful with portions of the label strip structure of FIG. 6A.

FIG. 6B shows a means to use the label 612 to identify a baby and/or their bassinet. Many babies in intensive care (born premature) are confined to an incubator and have very delicate skin. For these applications, it is desirable to also have a means to label the bassinet/incubator and to transfer the identification between the bed and the baby or to alternate locations on the baby. A banding means 650 is composed of a band 652, an insert holding means (e.g., pocket) 654, and an attachment means 656. A detailed description of the components follows.

The label 612 from the parent band is applied to an insert or other backing (e.g., card) containing desired patient information. The label 612/insert is placed into the transparent pocket 654 through an opening 658. The opening 658 of the pocket 654 may or may not be sealed by means of hook and loop, adhesive, snap closure, or equivalent structure. The pocket 654 is attached to the band 652 via a variety of methods including, but not limited to, ultrasonic welding, heat sealing, hook and loop, adhesive, RF welding, etc. The band 652 is made from skin compatible materials, including but not limited to, foam, gauze, cotton, nonwovens, vinyl, polyester, polypropylene, laminate structures, etc. The band 652 is applied to the extremity by wrapping an end 660 around the extremity and attaching it via the closure means 656 as shown in FIG. 6C. The closure means 656 can be hook and loop, adhesive, snap, etc. The closure 656 for neonates is one that can be reopened and reapplied, such as, hook and loop. The closure 656 for term babies is one that is permanent once closed.

In the case that the band 652 needs to be removed from the baby and applied to the bassinet and/or incubator, a device or holder 662 is used as shown in FIGS. 6D and 6E. The device 662 consists of a back panel 664 with attachment means 666 on a backside thereof. The back panel 664 can be composed of any material that is compatible with expected environmental conditions, has enough structural support, and is compatible with the manufacturing processes used. The means for attachment 666 to the bassinet and/or incubator include, but are not limited to, hook and loop, adhesive, clip, magnets, etc. The back panel 664 has a clear pocket 668 attached to a front side thereof via ultrasonic welding, RF welding, adhesive, heat seal, etc. and an attachment means 670. The band 652 (FIG. 6B) is removed from the baby and the insert 654 (FIG. 6C) is placed into the bassinet/incubator holder 662. An end 672 (FIG. 6C) of the insert 654 is placed into the pocket 668 and the band closure means 656 (FIG. 6B) is attached to the corresponding attachment means 670 on the holder 662. When the band 652 needs to be reapplied to the patient, it is removed from the holder 662 and reapplied. Given the correct configuration of the bassinet/incubator attachment means 666, the holder 662 can be moved to various incubators/bassinets as needed and/or desired.

Figure 7A:
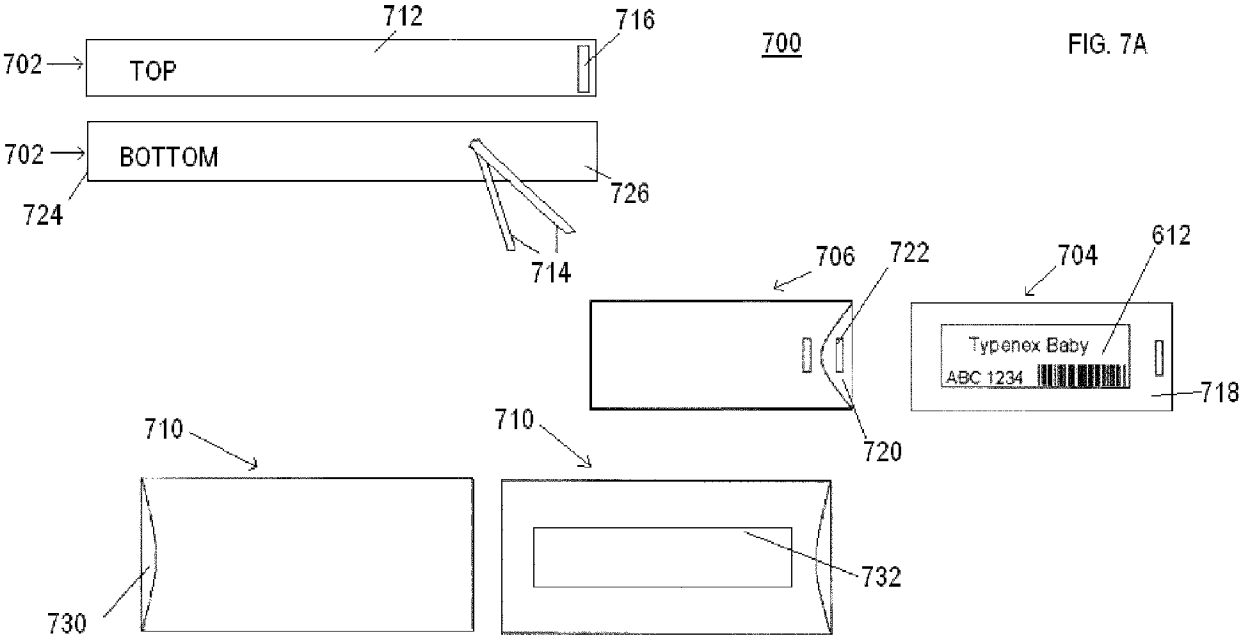
FIG. 7A is an exploded top view of a system for recipient verification in a parent/baby application.
Figure 7B:
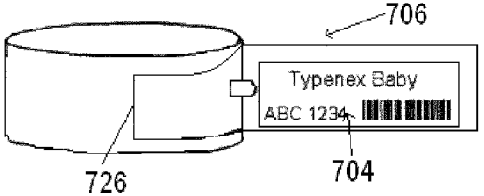
FIG. 7B is a simplified side view of the system of FIG. 7A in a worn state.

An alternate embodiment system 700 is shown in FIG. 7A. In this embodiment, a band 702 (top and bottom views of which are illustrated in FIG. 7A), an information insert 704, an insert protector 706, and a bassinet/incubator holder 710 (top and bottom views of which are illustrated in FIG. 7A) are provided as separate parts. This version of the system 700 allows a new band 702 to be used when needed. The band 702 is comprised of a base 712, an insert attachment means 714, and a closure means 716. The information insert 704 includes the baby label 612 as described above applied to a backing or card 718. The information insert 704 is then inserted into the protector 706 (e.g., a clear pocket) through an opening 720. The insert protector 706 (including the contained information insert 704) is then attached to the band 702. The attachment means 714 on the band 702 are threaded through an opening 722 in the insert protector 706. The attachment can be made in many ways including, but not limited to, snap closure, hook and loop, knot, adhesive, etc. In some embodiments, the attachment means 714 is one strap and loops back and attaches to the base band 702 via one of the means described. To apply the band 702 to recipient's the extremity, a first end 724 is placed on the extremity, and the band 702 is wrapped to size until an opposite end 726 can be attached via the closure means 716 as shown in FIG. 7B. The closure means 716 can be, but is not limited to, hook and loop, adhesive, snap closure, etc. The closure means 716 can be permanent or reusable.

In the event that the unique patient information needs to be moved from the patient to the bassinet/incubator, the insert protector 706 (including the contained information insert 704) is removed from the band 702 and inserted into the holder 710 via an opening 730 as reflected in FIG. 7A. The holder 710 is made from a clear material capable of withstanding the hospital environment. The holder 710 is attached to the bassinet/incubator via attachment means 732. The attachment means 732 can be but is not limited to, hook and loop, adhesive, clip, etc. If and when the band 702 needs to be reattached to the patient, the process described above is repeated using a new base band 702.

Removal of bands placed around patient extremities occurs due to a number of reasons including, lack of comfort, lack of access, swelling, and loss of durability. It is desirable to have a way to reattach a band after it has been removed and replace it on an extremity and/or alternate location on the body. Alternate location attachment (i.e. not attached around a wrist or ankle) is also desirable in cases where the band does not fit the patient, access is restricted, or the patient has a restricted extremity, among other reasons.

Although the present disclosure has been described with reference to preferred embodiments, workers skilled in the art will recognize that changes can be made in form and detail without departing from the spirit and scope of the present disclosure.

What is claimed is:

1. A recipient verification system comprising:

a band including:

a base defining:

a band identification portion displaying a predetermined band identifier, the band identification portion forming opposing first and second passages, a recipient information portion adjacent the band identification portion for receiving recipient-specific information, a trailing shield segment disposed over the band identification portion, a leading shield segment disposed over the recipient information portion, the leading shield segment having a first end secured to the base and a second end initially free of the base and subsequently bondable to the base for protecting recipient information applied to the recipient information portion, a strap extending from the base and terminating at a tail end; and a label strip extending from the base and including a first removable label displaying the predetermined band identifier;

wherein the recipient verification system is transitionable from an initial state in which the strap is free of the band identification portion to a worn state in which the strap is wrapped about a wearer's appendage, the tail end is passed through at least one of the passages, and a section of the strap is maintained along the band identification portion, and further wherein the predetermined band identifier on the band identification portion is visible through the trailing shield segment in the worn state.

2. The recipient verification system of claim 1, wherein the trailing shield segment protects the predetermined band identifier on the base from the environment in the worn state.

3. The recipient verification system of claim 1, wherein the trailing shield segment defines opposing first and second ends, and further wherein the first end of the trailing shield segment is secured to the base and the second end of the trailing shield segment is free of the base in the initial state.

4. The recipient verification system of claim 3, wherein the system is configured such that the second end of the trailing shield segment is bonded to the base in the worn state.

5. The recipient verification system of claim 3 configured such that transitioning from the initial state to the worn state includes passing the tail end through both of the passages and laminating the strap section between the band identification portion and the trailing shield segment.

6. The recipient verification system of claim 1, wherein the worn state includes the strap section maintained above the band identification portion and the band identifier on the band identification portion being visible through the trailing shield segment and the strap section.

7. The recipient verification system of claim 1, wherein the predetermined band identifier displayed on the base is printed on a permanent label contiguously formed as part of the label strip.

8. The recipient verification system of claim 7, wherein the label strip, including the permanent label, is completely formed apart from the band.

9. The recipient verification system of claim 7, wherein the first and second passages extend through a thickness of the permanent label.

10. The recipient verification system of claim 1, wherein the label strip is bonded to the base and extends in a direction opposite the strap in the initial state.

11. The recipient verification system of claim 1, wherein the band comprises:

a first web forming the strap and a first layer of the base;

a second web applied to the first web and forming a second layer of the base;

a shield layer bonded to the second web in a manner forming the leading and trailing shield segments; and an adhesive layer applied to the leading and trailing shield segments;

wherein the label strip is attached to the base adjacent the band identification section opposite the recipient information portion.

12. A method of manufacturing a recipient verification system, comprising:

forming a band including:

a base defining a recipient information portion and a band identification portion forming opposing passages, a leading shield segment disposed over the recipient information portion, the leading shield segment having a first end secured to the base and a second end initially free of the base and subsequently bondable to the base for protecting information applied to the recipient information portion, a trailing shield segment disposed over the band identification portion;

forming a label strip including a first removable label; and assembling the label strip to the band;

wherein upon final assembly, a predetermined band identifier is displayed on the band identification portion and the first removable label;

and further wherein the recipient verification system is transitionable from an initial state in which the strap is free of the band identification portion to a worn state in which the strap is wrapped about a wearer's appendage, the tail end is passed through at least one of the passages, and a section of the strap is maintained along the band identification portion, the predetermined band identifier on the band identification portion being visible through the trailing shield segment in the worn state.

13. The method of claim 12, wherein the band is cut from a first material web and the label strip is formed from a second material web differing from the first material web.

14. The method of claim 12, wherein the predetermined band identifier is printed onto the first removable label and the band identification portion.

15. The method of claim 12, wherein the label strip includes a permanent label, and further wherein forming the label strip includes:

printing the predetermined band identifier onto the first removable label and onto the permanent label.

16. The method of claim 15, wherein assembling the label strip to the band includes applying the permanent label to the band identification portion of the base.

17. The method of claim 12, wherein the worn state includes the strap section maintained above the band identification portion and the band identifier on the band identification portion is visible through the trailing shield segment and the strap section.

18. The method of claim 12, wherein the recipient information portion is sized to receive a label prepared by an end user displaying recipient-specific information, the recipient-specific information differing from the predetermined band identifier.

19. The method of claim 12, further comprising:

forming a plurality of recipient verification systems; and assigning a different predetermined band identifier to respective ones of the recipient verification systems.

20. A method of using a recipient verification system, the method comprising:

receiving a recipient verification system including:

a band including:

a base defining:

a band identification portion displaying a predetermined band identifier, the band identification portion forming opposing first and second passages, a recipient information portion, a trailing shield segment disposed over the band identification portion, a leading shield segment disposed over the recipient information portion, a strap extending from the base and terminating at a tail end, a label strip extending from the base and including a first removable label displaying the predetermined band identifier;

applying recipient information onto the recipient information portion;

covering the recipient information portion with the leading shield segment to protect the recipient information from the environment;

wrapping the strap about a recipient's appendage;

passing the tail end through at least one of the passages; and securing the strap to the base such that a section of the strap is maintained along the band identification portion, wherein the predetermined band identifier on the band identification portion is visible through the trailing shield segment.

21. The method of claim 20, wherein applying recipient information includes:

printing the recipient information onto a label; and bonding the label to the recipient information portion.

22. The method of claim 21, wherein the label is prepared apart from the base and the label strip.

* * * * *